US006000934A

United States Patent [19]

Shavers et al.

[11] Patent Number: 6,000,934

[45] Date of Patent: Dec. 14, 1999

[54] BURNER

[75] Inventors: Gerry L. Shavers, Ooltewah; Sherman D. Peed, Signal Mountain, both of Tenn.

[73] Assignee: Burner Systems International, Inc., Chattanooga, Tenn.

[21] Appl. No.: 09/237,470

[22] Filed: Jan. 26, 1999

[51] Int. Cl.[6] ..... F23D 14/64

[52] U.S. Cl. ..... 431/354; 239/432; 239/553.5; 239/590.5

[58] Field of Search ..... 431/354; 239/432, 239/553.5, 590.5, 499

[56] References Cited

U.S. PATENT DOCUMENTS 4,485,972 12/1984 Freber ..... 431/354

*Primary Examiner*—Carroll Dority

*Attorney, Agent, or Firm*—Alan Ruderman; Miller & Martin LLP

[57] ABSTRACT

An underfed burner has an elongated cylindrical body closed at both ends and a feed tube connected between the ends for feeding an air and gas fuel mixture into the burner through an entry portal. A pressure dispersing baffle is formed within the entry portal integral with the body of the burner and deflected downwardly into the interior of the burner. The baffle is in the form of two flaps supported by a rib integral with the body of the burner and extending across the entry portal. The baffle is formed by a die and a punch carried by the die. The die forms a depression about the opening created by the deflected baffles to define the portals and extends gradually longitudinally away from the flaps while the punch cuts the material to form the portal, the rib and the baffle flaps. A pair of mandrels enter the body of the burner from respective ends to provide support for the die and punch. One of the mandrels carries a pivotable support member which is pivoted into operative position by a cam carried by the other mandrel.

9 Claims, 3 Drawing Sheets

BURNER

BACKGROUND OF THE INVENTION

This invention relates to a gas burner of the type used extensively in gas fired fireplaces, in decorative gas logs used in fireplaces and in certain commercial dryers, and more particularly to a burner of this type having a unitary inlet baffle and a method for constructing a burner with such baffle.

An underfed burner comprises a feed tube which provides a venturi to draw in air along with gas fuel, the feed tube being connected in communication with an elongated burner body intermediate closed ends of the body. The gas and air mix within the body and produce a flame which burns at outlet ports along the length of the body. A burner of this construction permits entrainment and mixing of the gas and air to occur totally within the burner body itself. Additional mixing space at either side of the burner is not required. The problem encountered with the conventional underfed burner design is that dynamic pressure is seen at the outlet of the feed tube, such pressure causing local disturbances and instability in the flame. The instability of the flame at the outlet of the feed tube can result in excessive carbon monoxide which is undesirable and, in the case of unvented gas fireplace logs, is particularly dangerous and undesirable. The prior art thus incorporated a baffle member positioned and welded within the burner body to disperse the pressure surge and reduce the carbon monoxide to acceptable levels.

The baffles used in the prior art generally comprise a plate with apertures, the plate being positioned within the burner body at the location where the feed tube opens into the burner body and a small distance within the body in both directions from the opening. The baffle permits the gas and air entering into the burner to be dispersed to permit mixing in a controlled manner along the length of the baffle plate and beyond toward the ends of the burner and exit the burner body at the exit ports. The pressure surge at the outlet of the feed tube thereby is substantially reduced with a corresponding reduction in local flame disturbances. However, the process of locating and welding the baffle within the burner body is difficult, labor intensive, time consuming and costly. This may be readily understood from the fact that the baffle must be held within the body of a burner which has a substantially cylindrical configuration with a diameter in the order of approximately 1.25 inch and the baffle plate must extend across the body in the area of the entry into the body by a feed tube having a diameter also in the order of approximately 1.25 inches. Not only must the baffle be held but it also must be welded in position. Accordingly, this adds to the cost of the burner and also to performance inconsistencies from burner to burner. Additionally, welding of the feed tube to the burner body is also a difficult process and requires a special drilling operation to raise an edge to aid in locating the two tubes and an upstanding surface about which a 360 degree weld is made.

SUMMARY OF THE INVENTION

Consequently, it is a primary object of the present invention to provide an underfed burner having a pressure surge dispersing baffle in the burner body which is not required to be assembled into the burner.

It is another object of the present invention to provide an underfed burner having a pressure surge dispersion baffle which is not welded to the body of the burner.

It is a further object of the present invention to provide an underfed burner having a pressure surge dispersion baffle which is formed from and integral with the body of the burner, the baffle being a pair of wings or flaps deflected out of the surface and into the interior of the body.

It is a still further object of the present invention to provide a method of forming a pressure dispersing baffle within the body of an underfed burner at the location of the attachment of the gas/air feed tube, the method requiring no separate attachment of the baffle to the burner.

Accordingly, the present invention provides an underfed burner having an elongated body closed at each end and having a feed tube connected intermediate the closed ends for feeding air and gas fuel into the bumer, there being a pressure spreading or dispersing baffle disposed within the burner at the air and gas entrance, the baffle being deflected out of the body of the burner so that assembly and welding of a separate baffle, as in the prior art, is avoided.

The baffle may be a pair of flaps or wings extending on opposite sides of a central portion of the surface of the burner body deflected into the body of the burner so that air entry passages are provided between the deflected wings and the surfaces from which deflected.

The integral deflection wing overcomes the difficulties of the prior art deflecting baffle since the need for a separate plate positioned within and welded to the burner body is eliminated. The deflecting wings are formed by a punching operation utilizing a punch within an external die operating in conjunction with a mandrel internally positioned within the burner body prior to the closure of both ends of the burner. The die has a pair of sloped surfaces extending outwardly from a substantially cylindrical flattened surface forming the exterior of a housing within which the punch may slide, the punch having an inverted Vee cross sectional configuration with the central apex forming the undeflected portion of the burner body and the walls of the Vee together with the outer edge of the body of the punch acting to drive material out of the surface of the burner and into the body to form the wings.

The die and punch act against an internal mandrel or smash bar which supports the burner against the forces of the punch and die.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

Figure 1:
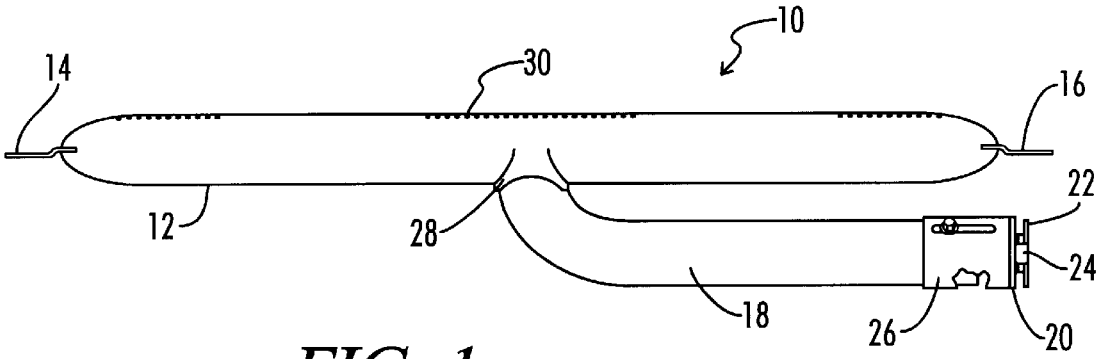
FIG. 1 (PRIOR ART)
FIG. 1 is a side elevational view of an underfed burner of the prior art.
Figure 2:
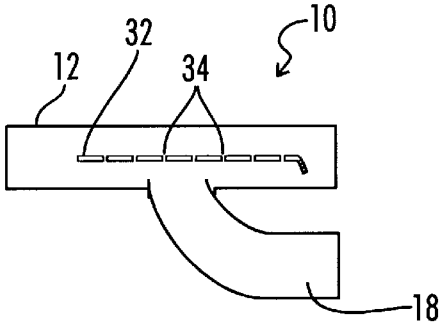
FIG. 2 (PRIOR ART)
FIG. 2 is a cross sectional view through the burner of FIG. 1.

Referring to the drawings, an underfed prior art burner 10 is illustrated in FIGS. 1 and 2, the burner comprising a burner body 12 having an elongated cylindrical configuration with the body closed at the ends by crimping the body adjacent the ends and forming flat mounting portions 14, 16 extending from the crimping for attachment to apparatus using the burner to provide a flame. Connected to the burner intermediate the ends by welding is a fuel feed tube 18 which also has a cylindrical configuration, and generally has the same diameter as the burner body 12. The feed tube 18 at the end remote from the weldment with the burner has an inlet end 20 for receiving gas fuel and for drawing in air by venturi action through a plate 22 having a gas inlet orifice 24 as is conventional, and may include a conventional gas/air adjustment member 26. At the weldment end, the feed tube 18 is received within and welded to an outstanding annular edge 28 which is formed during a special drilling operation required by the prior art, the drilling operation known as "T" drilling.

Disposed along the surface of the burner body generally diametrically remote from the fuel/air inlet is a multiplicity of outlet ports 30 which provide a flame front when the fuel mixture is ignited. As aforesaid, there is a dynamic pressure which occurs as the gas air mixture exits the feed tube and enters the burner body. This pressure distribution creates a flame instability at the flame front occurring at the outlet ports 30. Accordingly, the prior art provided a baffle in the form of a plate 32 within the burner body at the disposition of the entry of the fuel tube 18 and in either direction thereof, the plate having a plurality of apertures 34 therethrough for dispersing the gas/air mixture as it enters the burner body to thereby reduce substantially the dynamic pressure disturbance. The baffle plate 32 is located and held within the body of the burner and welded in place and, of course, such procedures are difficult and labor intensive, and therefore relatively expensive to perform. Additionally, the assembly of the fuel feed tube to the burner body by utilizing the special drilling operation to assist the welding of the two tubes is also difficult and cost ineffective.

Figure 3:
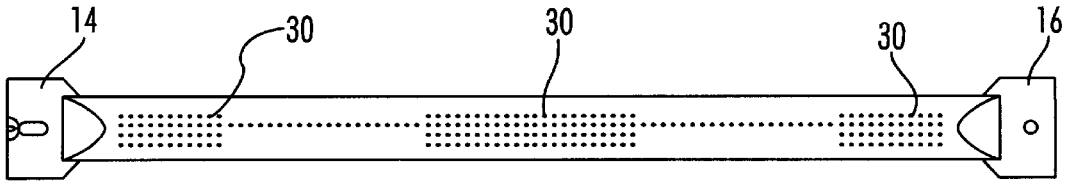
FIG. 3 is a bottom plan view of an underfed burner illustrating the outlet ports.
Figure 4:
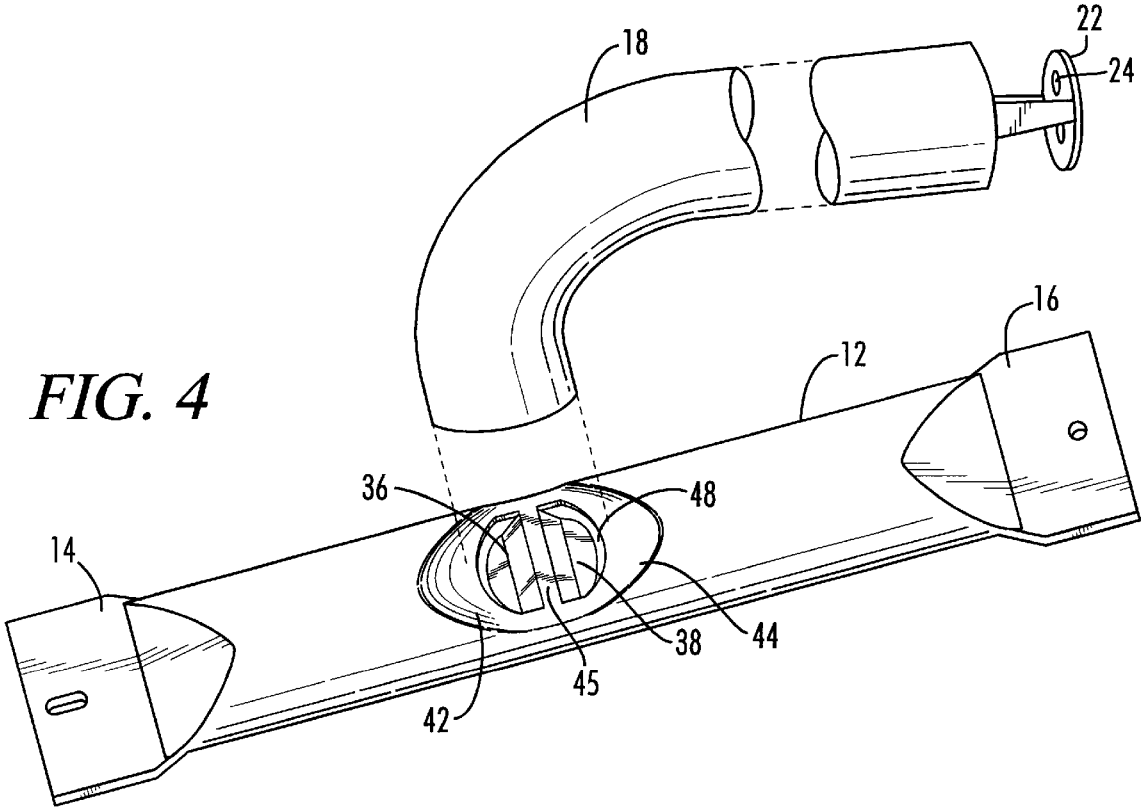
FIG. 4 is a perspective view partly broken away illustrating a burner constructed in accordance with the present invention.
Figure 5:
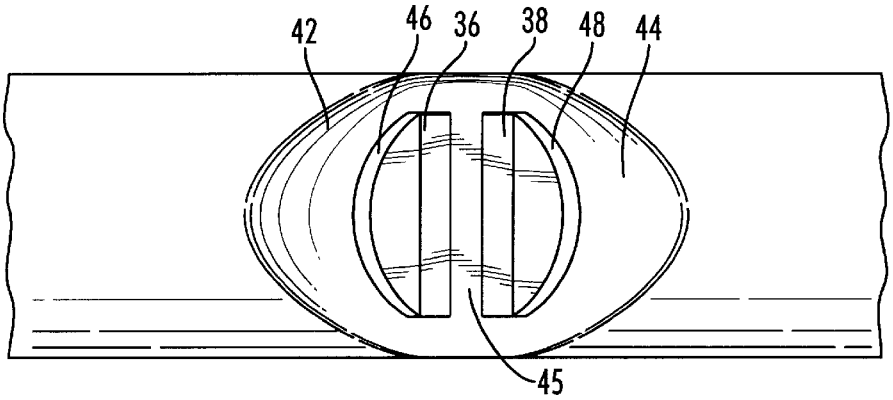
FIG. 5 is a fragmentary top plan view of the burner illustrated in FIG. 4.
Figure 6:
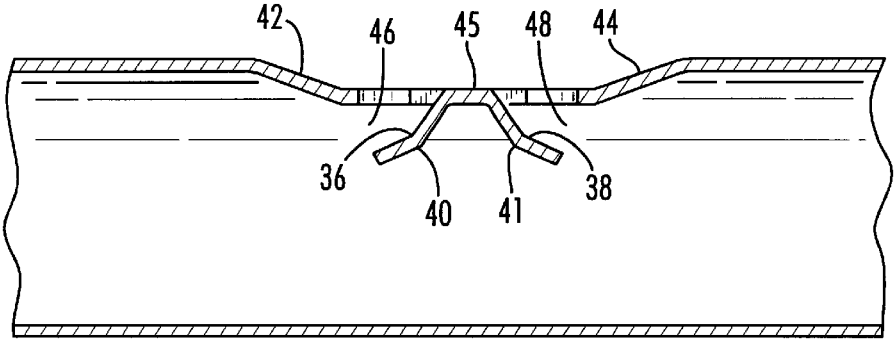
FIG. 6 is a cross sectional view taken substantially along line 6—6 of FIG. 5.

Consequently, the present invention overcomes these problems of the prior art by providing an underfed burner having a pressure surge dispersing baffle in the burner body at the location of the connection therein by the feed tube, the baffle being formed integral with the body of the burner. To this end, as illustrated in FIGS. 4 through 6, a pair of wings or flaps 36, 38 are deflected into the interior of the burner body 12 substantially intermediate the ends. It may be noted at this time that the burner illustrated in FIGS. 4 through 6 is the same as that illustrated in FIG. 1 except for the baffle construction and therefore the same reference numerals are used, and that the bottom view of the burner of FIGS. 4 through 6, as in the prior art, is illustrated in FIG. 3. The wings 36, 38, have respective creases 40, 41, and are formed below the bottom of a depression formed by an internally bulging surface 42, 44 extending gradually from the outer surface of the burner body longitudinally a small distance to the edge of the body from where the wings are deflected, that is the portion of the arcuate opening created by the deflection of the wings. By the wings or flaps being deflected down into the hollow of the burner body 12, the openings define respective fuel mixture entry portal 46, 48 formed by the space between the upper surface of the respective wings or flaps 36, 38 and the lower adjacent edge of the burner body from where the wings are deflected, as illustrated in FIG. 6, the wings having a rib 45 therebetween.

Figure 7:
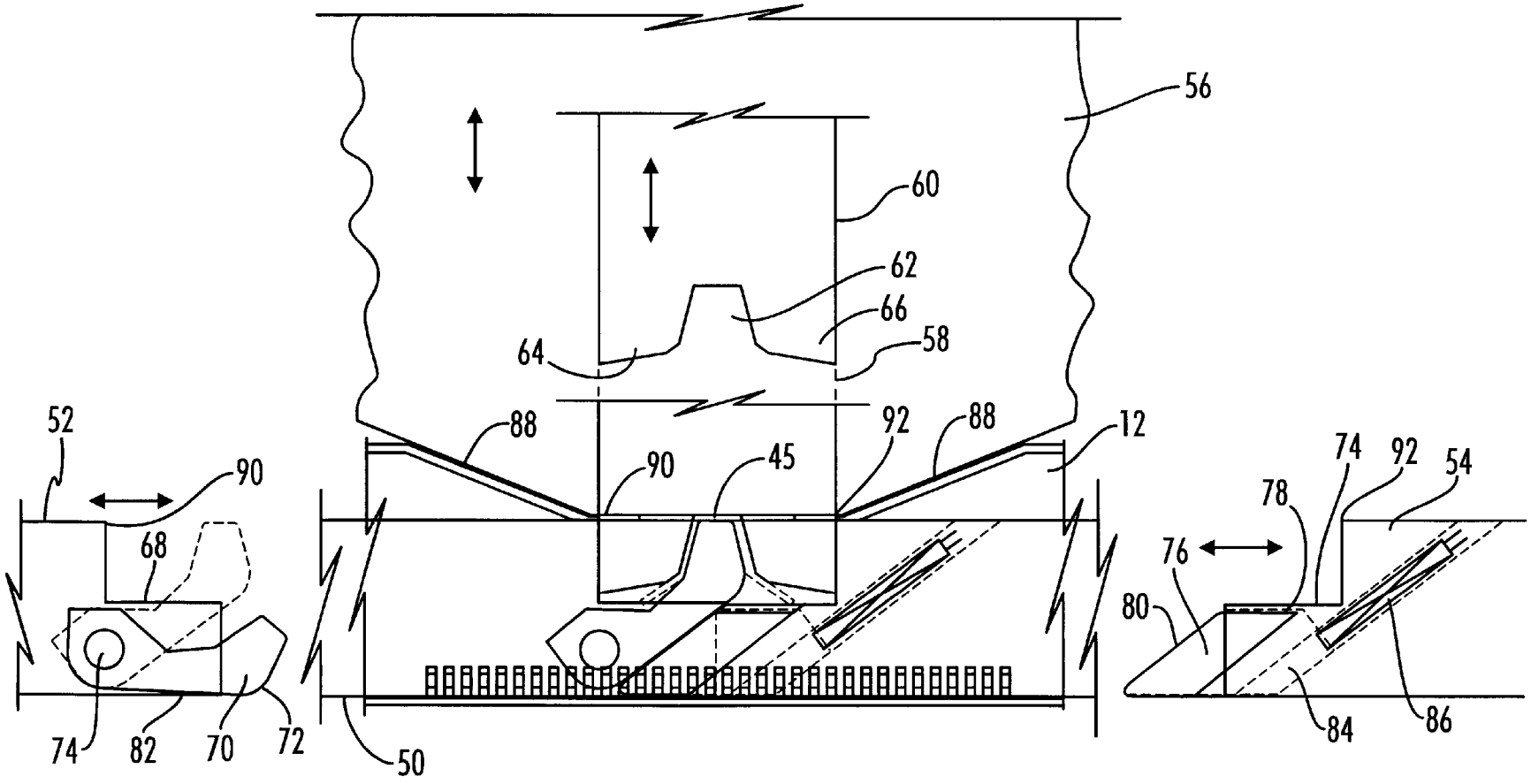
FIG. 7 is a diagrammatic view of apparatus for forming the burner baffles in accordance with the present invention with parts thereof shown in two positions.

In order to form the baffle wings 36, 38, and to deform the wings into the burner body to create the burner inlet portals 46, 48, the present invention provides a method of punching the burner body at the location of the fuel mixture inlet by means of a punch and die apparatus. Thus, as illustrated in FIG. 7, the burner body 12 may be supported longitudally by a cradle (not illustrated) which is mounted on a table 50, the cradle having a cross sectional configuration conforming to an elongated segment of the external cylindrical configuration of the burner body so as to support the same. The burner body, while the ends are still open, receives a respective mandrel 52, 54 through each end for providing a support in the area about the location where the baffle wings are to be formed. Each mandrel is moved into and out of the burner body by power drive means such as, preferably, hydraulic cylinders (not illustrated).

Mounted above the table 50 is a die assembly including a die member 56 which may be vertically driven into and out of contact with the burner body positioned on the cradle and supported internally by the mandrels 52 and 54. Movably mounted within a cylindrical cavity 58 forming a guide chamber within the die member 56 is a punch 60 having a substantially circular cross section and formed at its center with a recess 62 and having a pair of cutting and forming portions or prongs 64, 66 extending therefrom to complement the upper surface shape of the wings 36, 38 and the central rib 45. Preferably, both the die member 56 and the punch 60 are hydraulically driven vertically.

The mandrel 52 has a step 68 extending from the main portion thereof, the step being a vertically reduced portion of the mandrel and facing in the direction of the other mandrel 54. Pivotally mounted in a cut-out in the step portion 68 is a support member 70, the support member 70 having a cam edge 72 space from the pivot journal 74 and having a configuration for complementing and supporting the lower surface shape of the rib 45 an adjacent portion of the wings. The support member 70 has a complementary shape to that of the recess 62 of the punch and adjacent portions of the cutting and forming portions 64, 66.

The mandrel 54 also has a step configuration with a step 74 extending from the main portion facing toward the mandrel 52. At the leading edge of the step there is a cam 76 mounted within a slot 78, the cam 76 being adopted to contact the cam edge 72 of the support member 70 and cam or force it up as the cam 76 forces the member 70 to pivot. The shape of the leading edge 80 of the cam 76 complements the back 82 of the support member 70. Mounted within an inclined channel 84 within the mandrel 54 is a small reset spring 86.

In operation, the mandrel 52 is driven into the burner body 12 and while it is moving the mandrel 54 is driven into the burner body also. As the mandrel 52 stops its inward movement, the cam 76 engages the cam edge 72 and begins to force the support member upwardly about the pivot 74 until the outer portion is positioned beneath the material which forms the rib 45. The die member 56 also is driven downwardly as the two mandrels are driven inwardly, the die member having forming surfaces 88 which engage the burner body 12 form the portions 42 and 44 and the remainder of the connecting depression. The punch 60 is activated and acts against the burner body in cooperation with the edges 90, 92 at the steps of the respective mandrel 52, 54 to cut the openings 46, 48 as the recess 62 and the support member 70 support the material which forms the rib 45. As the punch, die and mandrels recede from the now formed burner body, the support member 70 pivots downwardly and, as the cam recedes into the slot 78, due to the release of pressure on it, the spring 86 nudges it and resets the cam. Thus, it may be seen that a two-piece mandrel operating with a die and an internal punch, is utilized the form the burner body and may be removed after the baffle portion of the burner is formed. Thereafter the ends of the burner body are closed by conventional means.

With the construction of a baffle according to the present invention, it has been found in tests that carbon monoxide levels have been reduced even further than the levels provided by the prior art separate baffle plate designs. It also appears that results are more consistent, and this appears to be the result of the precise control, accuracy and repeatability of forming the entry portals 46, 48 as the baffles are formed. Thus, the control, accuracy and repeatability of the method of forming the baffles and the entry portals is superior to the prior art method of locating and welding a separate baffle within the burner body.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. An underfed burner comprising a burner body having a hollow substantially cylindrical configuration including a pair of closed ends, a fuel mixture entry portal disposed intermediate said closed ends for receiving a gas and air fuel mixture and permitting said fuel mixture to further mix within the burner body, a plurality of outlet ports spaced longitudinally along the burner body for egress of the fuel mixture from the body through the outlet ports, a depression in the surface of the burner body about the entry portal formed by a radially inward deflection in the outer surface of the burner body extending gradually from the outer surface of the burner body at a location spaced longitudinally from the portal and extending to adjacent the portal, a central rib integral with said burner body extending across said portal transverse to the longitudinal axis of said burner body, a baffle comprising a pair of flaps formed integral with said rib disposed within said portal, and a feed tube having an inlet end for ingress of air and gas and having an outlet end fastened to said burner body in flow communication with said entry portal.

2. An underfed burner as recited in claim 1, wherein said flaps are disposed at an angle inclined relative to said rib and relative to said burner axis.

3. An underfed burner comprising a burner body having a hollow substantially cylindrical configuration including a pair of closed ends, a fuel mixture entry portal disposed substantially intermediate said closed ends for receiving a gas and air fuel mixture and permitting said mixture to further mix within the burner body, a plurality of outlet ports spaced longitudinally along the burner body for egress of the fuel mixture through said outlet ports, a depression in the surface of the burner about the entry portal formed by a radially inward deflection in the outer surface of the burner body extending gradually from the outer surface of the burner body at a location spaced longitudinally from the portal and extending to adjacent the portal, a baffle formed integral with said burner body and extending into the interior of the burner body at said portal and at an angle relative to the longitudinal axis of the burner body, and a feed tube having an inlet end for ingress of air and gas and an outlet end fastened to said burner body in flow communication with said inlet portal.

4. A method of forming a pressure dispersion baffle in an underfed burner having a metal body comprising a hollow substantially cylindrical configuration, said method comprising:

(a) supporting said body with a circumferential portion of the surface exposed;

(b) positioning a pair of mandrels within said body, each mandrel being received from a respective end of said body;

(c) forcibly changing said circumferential portion with a die to deform the exposed surface and provide a central depression having a pair of spaced apart surfaces extending from the depression longitudinally substantially gradually to the undeformed peripheral surface of said body;

(d) driving a punch into said central depression while said die engages the body to puncture the material in said depression to form at least one flap and deflect said flap into the interior of said body without detaching said flap from the body; and (e) removing the mandrels.

5. A method as recited in claim 4, wherein said die includes a pair of spaced apart inclined die surfaces with a punch receiving cavity therebetween, said method comprising forcing said inclined surfaces against said exposed surface to form the surfaces extending from the depression to the undeformed surface of said body.

6. A method as recited in claim 4, wherein one of said mandrels includes a pivotally mounted support member, and the other of said mandrels includes a cam, and said method comprises forcing said cam against said support member to pivot said support member into position to cooperate with said punch to form said at least one flap and a rib therebetween.

7. A method as recited in claim 5, wherein said punch comprises a pair of prongs and is reciprocally driven relative to said cavity to form and deflect two flaps into said body.

8. A method as recited in claim 6, wherein said die includes a pair of spaced apart inclined die surfaces with a punch receiving cavity therebetween, said method comprising forcing said inclined surfaces against said exposed surface to form the surfaces extending from the depression to the undeformed surface of said body.

9. A method as recited in claim 8, wherein said punch comprises a pair of prongs and is reciprocably driven relative to said cavity to form and deflect two flaps into said body.

* * * * *